US010207504B2

(12) United States Patent
Ono

(10) Patent No.: US 10,207,504 B2
(45) Date of Patent: Feb. 19, 2019

(54) PRINTING APPARATUS AND PRINTING METHOD

(71) Applicant: Seiko Epson Corporation, Tokyo (JP)

(72) Inventor: Satoru Ono, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/445,143

(22) Filed: Feb. 28, 2017

(65) Prior Publication Data

US 2017/0253035 A1 Sep. 7, 2017

(30) Foreign Application Priority Data

Mar. 7, 2016 (JP) ..... 2016-043088

(51) Int. Cl.
*B41J 2/145* (2006.01)
*B41J 2/165* (2006.01)

(52) U.S. Cl.
CPC ..... *B41J 2/145* (2013.01); *B41J 2/165* (2013.01); *B41J 2002/16573* (2013.01)

(58) Field of Classification Search
CPC ..... B41J 2/145; B41J 2/165; B41J 2/16573
USPC ..... 347/7
See application file for complete search history.

(56) References Cited

U.S. PATENT DOCUMENTS 4,858,171 A * 8/1989 Furusawa ..... B41J 5/46 400/63
5,459,496 A * 10/1995 Hanabusa ..... B41J 2/1652 347/23
7,440,144 B2 * 10/2008 Yamaguchi ..... H04N 1/0053 250/573
7,916,317 B2 * 3/2011 Kitamura ..... G06K 15/005 358/1.13
8,711,384 B2 * 4/2014 Suzuki ..... G06F 3/1212 358/1.14
2014/0002525 A1 * 1/2014 Takeishi ..... B41J 2/07 347/14
2014/0063087 A1 3/2014 Mitsui
2016/0046139 A1 * 2/2016 Endo ..... B41J 3/4075 428/32.18

FOREIGN PATENT DOCUMENTS

JP 2014-047443 A 3/2014

* cited by examiner

*Primary Examiner* — Huan Tran
*Assistant Examiner* — Alexander D Shenderov
(74) *Attorney, Agent, or Firm* — Nutter McClennen & Fish LLP; Alex Nagorniy

(57) ABSTRACT

A printing apparatus includes a medium transport mechanism that transports a recording medium in a transport direction, a print head that ejects a liquid onto the recording medium, a printing section that performs printing by ejecting a liquid from the print head onto the recording medium based on print data, and a controller that controls a suspension and a resumption of a printing operation at a dividing position that has been designated in the print data.

8 Claims, 9 Drawing Sheets

PRINTING APPARATUS AND PRINTING METHOD

BACKGROUND

1. Technical Field

The present invention relates to a printing apparatus and a printing method.

2. Related Art

In recent years, ink jet printing apparatuses that print a pattern or the like on a recording medium by ejecting ink from a print head to the surface of the recording medium have been used in textile printing for a fabric (a recording medium) such as cotton, silk, wool, synthetic fibers, mixed spinning. In such printing apparatuses, since a printing operation is performed over a long time while a long recording medium is being transported in a roll-to-roll system, it is necessary to suspend the printing operation for maintenance of a print head. Thus, JP-A-2014-47443 discloses an ink jet recording apparatus (printing apparatus) that suspends and resumes a printing operation halfway without causing a reduction in the value of a print.

Even in the printing apparatus disclosed in JP-A-2014-47443, however, a position at which a printing operation is suspended and resumed may be visually recognized more or less. For example, when a printing operation is suspended in the middle of a picture of a person, an object, or the like, a color unevenness, a color difference, or the like may be clearly observed and thus the commercial value of a print may be reduced. This may cause a problem of a reduction in the productivity of the printing apparatus.

SUMMARY

Application Example 1

A printing apparatus according to the present application example includes: a medium transport mechanism that transports a recording medium in a transport direction; a print head that ejects a liquid onto the recording medium; a printing section that performs printing by ejecting a liquid from the print head onto the recording medium based on print data; and a controller that controls a suspension and a resumption of a printing operation at a dividing position that has been designated in the print data.

According to this application example, the printing apparatus has the controller that, when there is a need for suspending the printing operation, controls a suspension and a resumption of a printing operation at a dividing position that has been designated in the print data. The dividing position has been designated based on the print data to a location where a boundary due to a suspension and a resumption of a printing operation is less likely to be visually recognized, which can prevent production of a print of lower commercial value. Therefore, a printing apparatus with improved productivity can be provided.

Application Example 2

The printing apparatus according to the application example described above may include a maintenance section that performs maintenance of the print head, and the controller may cause the maintenance section to perform maintenance of the print head between the suspension and the resumption of the printing operation.

According to this application example, when suspending a printing operation for maintenance of the print head, the printing apparatus suspends the printing operation after performing printing up to a dividing position that has been designated in the print data and resumes the printing operation from the dividing position when the maintenance is completed. The dividing position has been designated based on the print data to a location where a boundary due to a suspension and a resumption of a printing operation is less likely to be visually recognized, which can prevent production of a print of lower commercial value due to maintenance. Therefore, a printing apparatus with improved productivity can be provided.

Application Example 3

In the printing apparatus according to the application example described above, the dividing position may be indicated by a continuous line running from one end to the other end of the recording medium in a scanning direction intersecting the transport direction.

According to this application example, a dividing position can be set for various images by designating the dividing position by a continuous line running from one end to the other end of the recording medium in the scanning direction.

Application Example 4

In the printing apparatus according to the application example described above, the continuous line may be a straight line.

According to this application example, when fundamental images (unit images) are arranged in the transport direction, an image in which a color unevenness or a color difference due to a suspension and a resumption of a printing operation is less likely to be visually recognized can be printed by setting a dividing position along boundaries between unit images by a straight line.

Application Example 5

In the printing apparatus according to the application example described above, the continuous line may be a comb-teeth line.

According to this application example, when a plurality of lengthwise unit images in which fundamental images (unit images) are arranged in the transport direction are arranged in a staggered manner in the scanning direction, an image in which a color unevenness or a color difference due to a suspension and a resumption of a printing operation is less likely to be visually recognized can be printed by setting a dividing position along boundaries between unit images by a comb-teeth line.

Application Example 6

In the printing apparatus according to the application example described above, a region occluded by a first straight line that contacts with an upstream end of the continuous line and runs in the scanning direction and a second straight line that contacts with a downstream end of the continuous line and runs in the scanning direction may be defined as a dividing region, and the controller may mask a region occluded by the first straight line and the continuous line and perform printing up to the dividing region when suspending a printing operation and may mask a region occluded by the second straight line and the continuous line and perform printing from the dividing region when resuming a printing operation.

According to this application example, the printing apparatus masks a region occluded by the first straight line and the continuous line and prints the dividing region when suspending a printing operation and then masks a region occluded by the second straight line and the continuous line and prints the dividing region when resuming the printing operation. In other words, since the dividing region is subjected to printing before the suspension and after the resumption of a printing operation, the same print data can be used for printing by preparing different masks for not ejecting a liquid. With print data of a dividing region being held after a suspension of a printing operation, the time for reloading print data can be omitted and the time before resuming the printing operation can be reduced. This can improve a productivity of the printing apparatus.

Application Example 7

The printing apparatus according to the application example described above may further include a display unit that indicates one or more candidate dividing positions for suspending a printing operation to instruct a selection.

According to this application example, since the printing apparatus has the display unit that indicates one or more candidate dividing positions for suspending a printing operation to instruct a selection, a user can designate a dividing position at which a boundary due to a suspension and a resumption of a printing operation is less likely to be visually recognized while confirming the image on the display unit.

Application Example 8

The printing apparatus according to this application example described above is a printing method of a printing apparatus. The printing apparatus includes a medium transport mechanism that transports a recording medium in a transport direction, a print head that ejects a liquid onto the recording medium, a printing section that performs printing by ejecting a liquid from the print head onto the recording medium based on print data. The method includes: suspending a printing operation at a dividing position that has been designated in the print data; and resuming the printing operation.

According to this application example, the printing method of the printing apparatus includes, when there is a need of suspending a printing operation, steps of suspending a printing operation at a dividing position that has been designated in the print data and resuming the printing operation. The dividing position has been designated based on the print data to a location where a boundary due to a suspension and a resumption of a printing operation is less likely to be visually recognized, which can prevent production of a print of lower commercial value. Therefore, a printing method with improved productivity can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the drawings. Note that, in each of the drawings, the scale of each layer, each member, or the like may be different from the actual implementation and each layer, each member, or the like may be enlarged in order to be recognizable.

Further, in FIG. 1, FIG. 4, FIG. 5, and FIG. 8, as an X-axis, a Y-axis, and a Z-axis are depicted as three axes orthogonal to each other, and each arrowhead side of the arrows representing the axis directions is defined as "+side" and each base side of the arrows is defined as "−side". Further, in the following, a direction parallel to the +X-axis, which is a direction in which a recording medium is transported, is referred to as the "X-axis direction", a direction parallel to the +Y-axis, which is a direction that intersects the transporting direction of a recording medium and in which a print head becomes distant from a maintenance section, is referred to as the "Y-axis direction", and a direction parallel to the −Z-axis, which is a direction in which ink is ejected from the print head onto a recording medium, is referred to as the "Z-axis direction".

First Embodiment

General Configuration of Printing Apparatus

Figure 1:
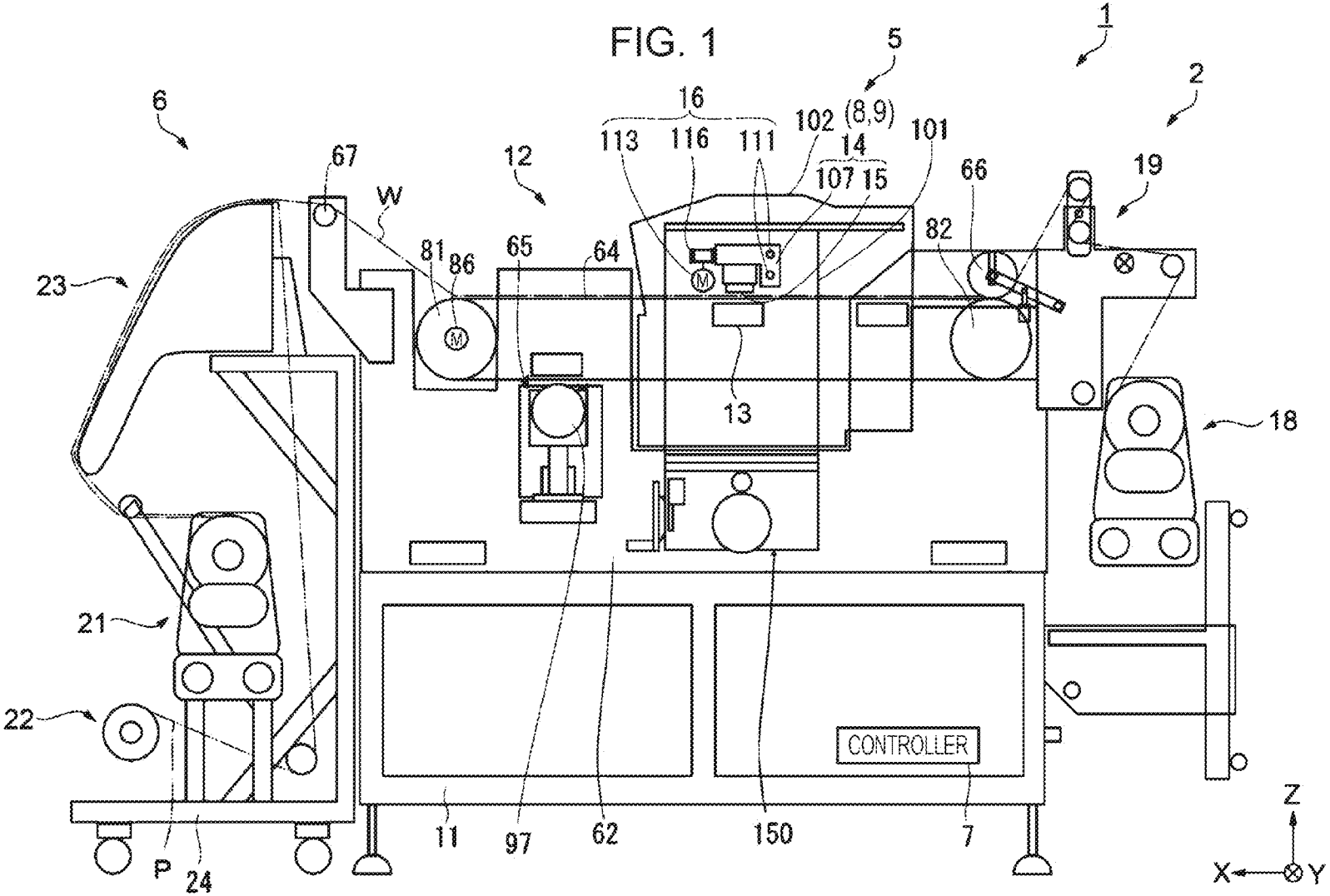
FIG. 1 is a schematic diagram illustrating the entire general configuration of a printing apparatus according to a first embodiment.

FIG. 1 is a schematic diagram illustrating the entire general configuration of a printing apparatus according to the first embodiment. First, the general configuration of a printing apparatus 1 according to this embodiment will be described with reference to FIG. 1. Note that this embodiment exemplifies the printing apparatus 1 of an ink jet system that transports a recording medium W in a roll-to-roll system and forms an image or the like thereon to perform textile printing on the recording medium W.

As illustrated in FIG. 1, the printing apparatus 1 has a send-out section 2 that sends out and feeds the recording medium W, a medium transport mechanism 12 that transports the recording medium W in a transport direction (+X axis direction), a printing section 5 that cooperates with the medium transport mechanism 12 to perform printing on the recording medium W, a winding section 6 that collects the recording medium W, a maintenance section 13, and a cleaning unit 65. Further, the printing apparatus 1 has a controller 7 that entirely controls each of the above components. Further, the printing apparatus 1 has a display unit 8 and an operating unit 9 that form a user interface.

First, a path for the recording medium W from the send-out section 2 to the winding section 6 will be described.

The send-out section 2 transports the recording medium W in the transport direction (+X-direction in the printing section 5) and is provided upstream of the printing apparatus 1 in the transport direction of the recording medium W. The send-out section 2 has a send-out unit 18 that holds and sends out a rolled belt-shaped recording medium W to the medium transport mechanism 12 and a tension unit 19 that removes slack in the sent out recording medium W. As the recording medium W, a fabric such as cotton, wool, polyester, or the like may be used, for example.

The medium transport mechanism 12 supplies to the printing section 5 the recording medium W sent out from the send-out section 2. The medium transport mechanism 12 is supported by a pair of left and right side frames 62 (in the ±Y-axis direction) that are placed and fixed on a base stage 11 formed of assembled steel members. The medium transport mechanism 12 has a driving pulley 81 located downstream in the transport direction (hereafter, also referred to as secondary scanning direction), a driven pulley 82 located upstream in the transport direction, and a transport belt 64 hung between the driving pulley 81 and the driven pulley 82. The driving pulley 81 and the driven pulley 82 are supported in a rotatable manner by a pair of side frames 62 via a dedicated bearing. One axial end of the driving pulley 81 is coupled to a transport motor 86 as a motive power source that moves the transport belt 64 intermittently.

The transport belt 64 is an endless belt formed such that both ends of the belt that is wider than the width of the recording medium W are connected to each other, and an adhesive layer that adheres to the recording medium W is provided on the surface of the transport belt 64. In the upstream side of the transport belt 64, a pressing roller 66 that presses the recording medium W placed on the transport belt 64 to adhere the recording medium W onto the transport belt 64 is provided. The transport belt 64 is held between the driving pulley 81 and the driven pulley 82 with a predetermined tension being applied thereto and, in response to the transport motor 86 being driven, transports the recording medium W that has adhered to the transport belt 64 by the pressing roller 66 in the transport direction (+X-axis side). Thereby, a stretchable fabric or the like can be handled as the recording medium W. The recording medium W after being printed by the printing section 5 is separated from the transport belt 64 by a separation roller 67 provided downstream of the medium transport mechanism 12 and relayed to the winding section 6. Note that, although the transport belt 64 has been described as having an adhesive layer for adhesion of the recording medium W, the transport belt 64 is not limited thereto. For example, the transport belt may be an electrostatic chuck belt that adsorbs the recording medium W by using static electricity.

The winding section 6 is mounted on a winding section stage 24 that is provided downstream of the printing apparatus 1 in the transport direction of the recording medium W. The winding section 6 has a winding unit 21 that winds the printed recording medium W into a roll and collects the roll. Furthermore, the winding section 6 has a heater unit 23 that evaporates a solvent of dye ink (moisture) soaked into the recording medium W before winding the recording medium W and an interleaving sheet unit 22 that supplies an interleaving sheet P to the winding unit 21. This allows the winding unit 21 to wind the belt-shaped recording medium W in which an image or the like is formed.

Next, the printing section 5 will be described.

The printing section 5 is arranged in the upper side (+Z-axis direction) of the medium transport mechanism 12. The printing section 5 has a carriage unit 14, a carriage motion mechanism 16 that moves the carriage unit 14 in a primary scanning direction (Y-axis direction) intersecting the transport direction. Furthermore, the carriage unit 14 has a print head 15 that has nozzle arrays for a plurality of colors used for color printing and ejects dye ink as a liquid onto the recording medium W and a carriage 107 on which the print head 15 is mounted such that the nozzle arrays are arranged parallel to the X-axis direction. The dye ink for each color supplied to each nozzle array is supplied from an ink tank (not illustrated) and ejected onto the recording medium W from the print head 15 in accordance with control by the controller 7. The carriage unit 14, the carriage motion mechanism 16, and the like are covered with a printer cover 102.

The carriage motion mechanism 16 has two carriage guides 111 that support the carriage unit 14 in a slidable manner in the Y-axis direction. The carriage guides 111 are bridged across the printer frame 101 built outside (in the ±Y-axis sides of) the transport belt 64 in the X-axis direction. Furthermore, the carriage motion mechanism 16 has a timing belt 116 that reciprocates the carriage unit 14 along the carriage guides 111 and a carriage motor 113 as a motive power source that causes the timing belt 116 to move forward and backward. When the carriage motor 113 is driven and thereby the timing belt 116 is moved forward and backward, the print head 15 with the carriage unit 14 is guided by the carriage guides 111 and reciprocated in the ±Y-axis direction. Note that, although a serial head system that is mounted on the reciprocating carriage 107 and ejects ink while moving in the width direction (±Y-axis direction) of the recording medium W has been exemplified in this embodiment, a line head system in which a print head is fixedly aligned extending in the width direction (Y-axis direction) of the recording medium W may be employed.

The display unit 8 and the operating unit 9 are provided in the external surface (the printer cover 102) of the printing section 5. The display unit 8 is formed of a liquid crystal display, for example, and the operating unit 9 is formed of various hard keys, a touch screen, or the like provided on the surface of the display unit 8 (a liquid crystal display). The display unit 8 displays various command choices as Graphical User Interface (GUI) buttons or the like and various commands can be input by a user selecting a command through the operating unit 9.

Further, the printing section 5 has a gap adjuster 150 that moves the entire printing section 5 up and down with respect to the medium transport mechanism 12 and thereby adjusts the distance (work gap) between the nozzle face of the print head 15 and the recording medium W placed on the transport belt 64. As a mechanism of the gap adjuster 150, a mechanism of a combination of a ball screw and a ball nut, a linear guide mechanism, or the like may be employed, for example.

The maintenance section 13 is provided outside one end of the transport belt 64 in the Y-axis direction in which the carriage unit 14 (the print head 15) reciprocates, and provided at a position overlapping the print head 15 reciprocating in the Y-axis direction in a plan view from the +Z-axis direction. The maintenance section 13 includes an absorption section (not illustrated) that absorbs ink from the nozzle of the print head 15, a wiping section (not illustrated) that performs wiping to remove ink attached on the nozzle face of the print head 15, and a flushing section (not illustrated) that performs flushing to cause the nozzle of the print head 15 to eject ink.

The cleaning unit 65 is provided on the lower side (−Z-axis side) of the medium transport mechanism 12. The cleaning unit 65 cleans up, from the lower side (−Z-axis direction), the surface of the transport belt 64 from which the recording medium W has been separated and that moves from the driving pulley 81 to the driven pulley 82. The cleaning unit 65 has a rotary brush 97 that comes into contact with the transport belt 64 and is rotary-driven, and removes ink, a fiber of a fabric, or the like attached to the surface of the transport belt 64.

Electrical Configuration

Figure 2:
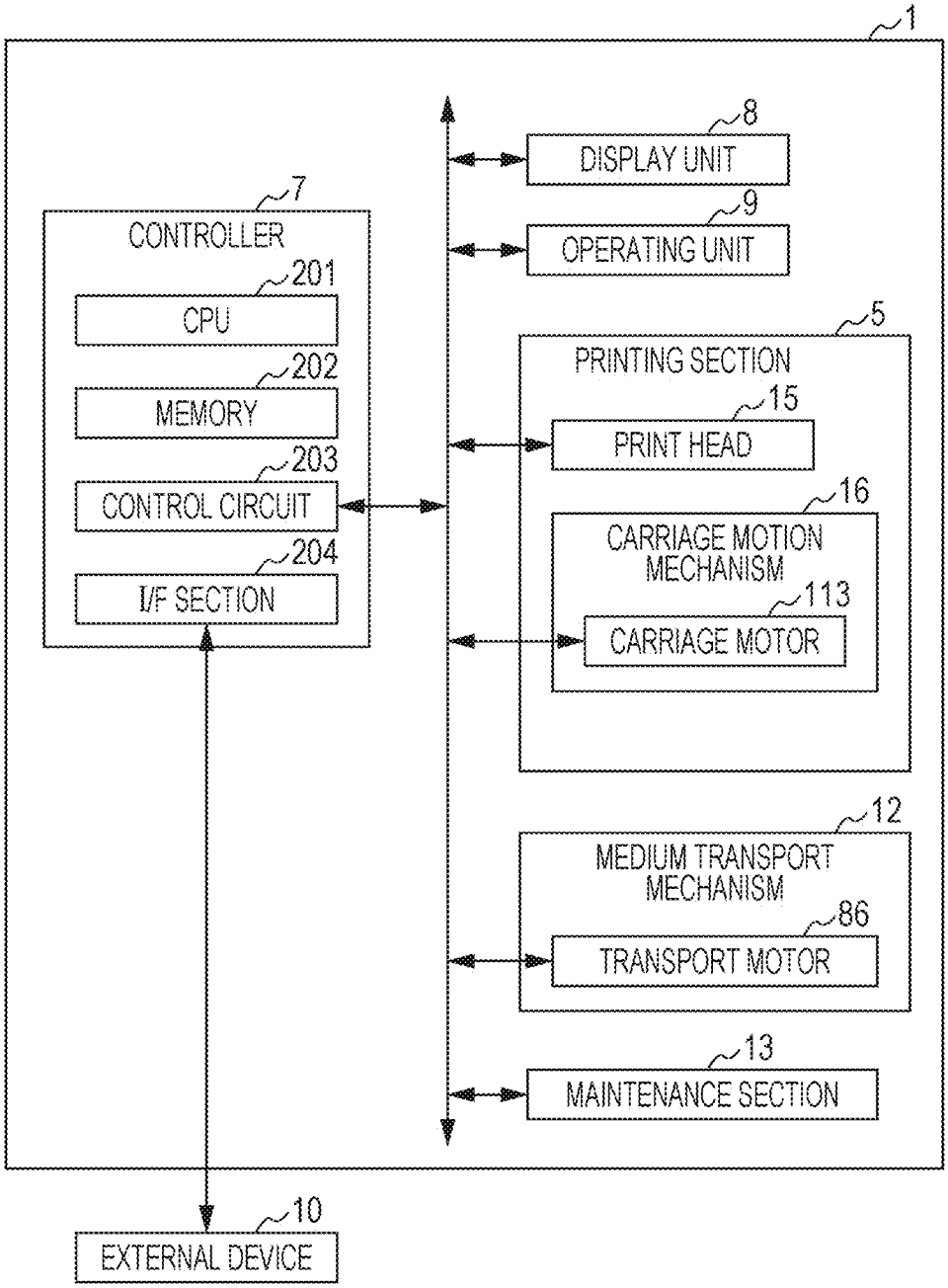
FIG. 2 is an electrical block diagram illustrating an electrical configuration of the printing apparatus.

FIG. 2 is an electrical block diagram illustrating an electrical configuration of the printing apparatus. Next, the electrical configuration of the printing apparatus 1 will be described with reference to FIG. 2.

As illustrated in FIG. 2, the printing apparatus 1 has the controller 7 that controls each component provided to the printing apparatus 1. The controller 7 has a Central Processing Unit (CPU), a memory 202, a control circuit 203, and an interface section 204 (I/F section). The I/F section 204 is for transmission and reception of data between the controller 7 and the external device 10 that handles an input signal, image, or the like. A desktop or laptop personal computer (PC), a tablet terminal, a mobile terminal, or the like may be used as an external device 10. Note that, although the external device 10 has been exemplified as being provided separately from the printing apparatus 1, the external device may be provided in an integral manner with the printing apparatus.

The CPU 201 is a processing unit for processing input signals from the operating unit 9, various detectors (not illustrated), or the like and controlling the entire printing apparatus 1.

The memory 202 secures an area for storing a program executed by the CPU 201, a working area, or the like and has a storage device such as a Random Access Memory (RAM), an Electrically Erasable Programmable Read-Only Memory (EEPROM), or the like.

The control circuit 203 outputs a control signal based on an operation process of the CPU 201 and controls each member of the printing apparatus 1.

According to such a configuration, the controller 7 outputs a control signal from the control circuit 203 and controls the transport motor 86 provided in the medium transport mechanism 12 to move the recording medium W supplied from the send out section 2 in the transport direction (the secondary scanning direction (+X-axis direction)). The controller 7 outputs a control signal from the control circuit 203 and controls the carriage motor 113 provided to the carriage motion mechanism 16 to move the carriage unit 14 mounted on the print head 15 in the primary scanning direction. The controller 7 outputs a control signal from the control circuit 203 and controls driving of the print head 15 to eject ink onto the recording medium W. The controller 7 outputs a control signal from the control circuit 203 and causes the display unit 8 to display various information. The controller 7 outputs a control signal from the control circuit 203 and controls a motor, a load device (not illustrated), or the like provided to the maintenance section 13 to perform maintenance of the print head 15. Further, the controller 7 can control various devices (not illustrated).

The controller 7 controls the carriage motion mechanism 16 and the print head 15 to perform a primary scan that moves the carriage unit 14 (the print head 15) in the primary scanning direction (Y-axis direction) while causing the print head 15 to eject ink, and thereby a raster line on which a plurality of dots are aligned in the Y-axis direction is formed. The controller 7 repeats the primary scanning described above and a secondary scanning in which the medium transport mechanism 12 is controlled to transport the recording medium W in the secondary scanning direction (+X-axis direction), and thereby a plurality of raster lines are formed in the X-axis direction and an image or the like is printed on the recording medium W.

Figure 3:
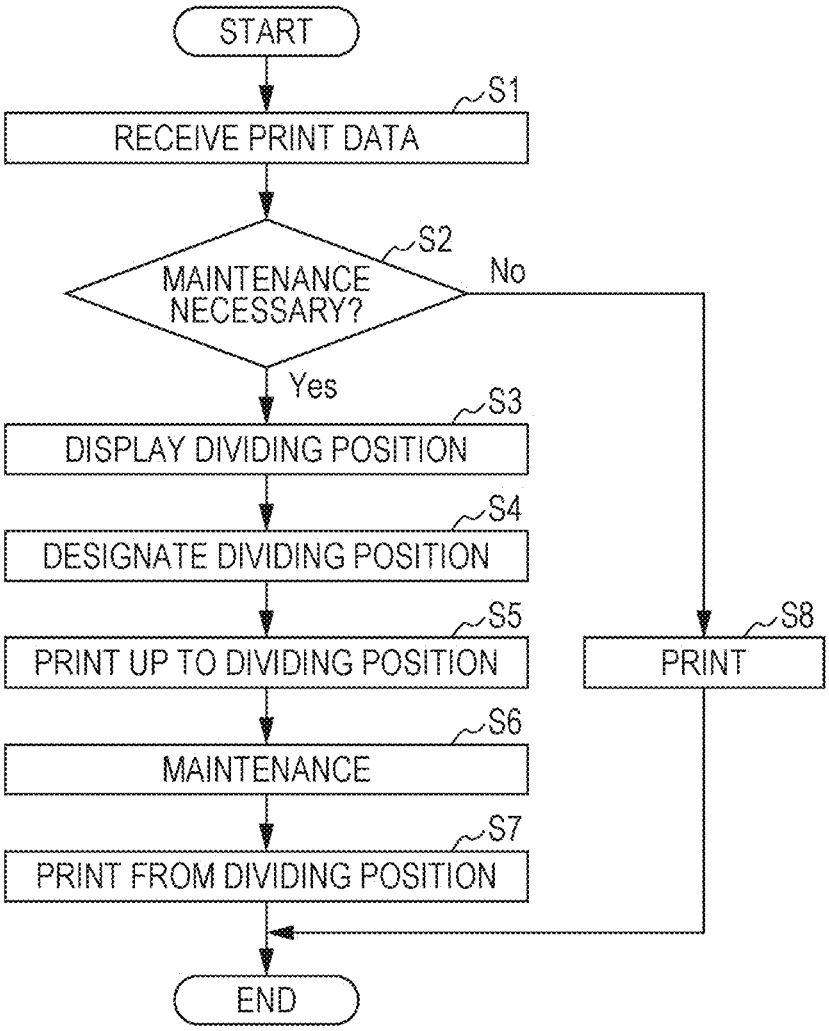
FIG. 3 is a flowchart illustrating a printing operation.
Figure 4:
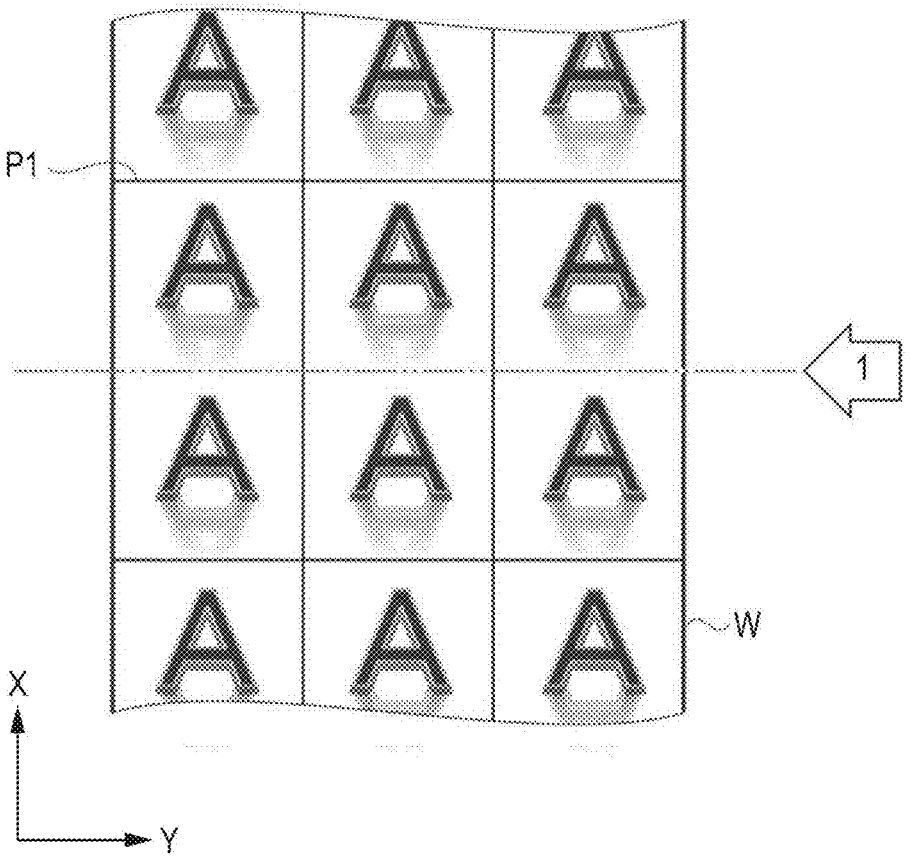
FIG. 4 is a diagram illustrating an example of a dividing position displayed on a display unit.
Figure 5:
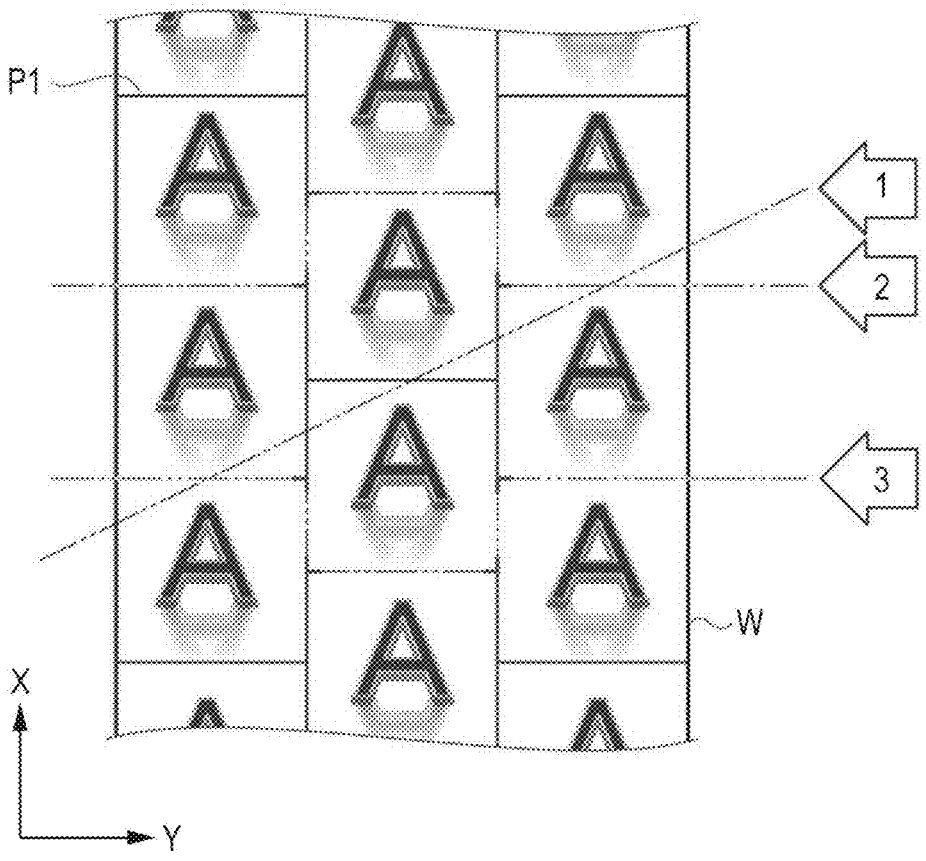
FIG. 5 is a diagram illustrating an example of a dividing position displayed on a display unit.

FIG. 3 is a flowchart illustrating a printing operation. FIG. 4 and FIG. 5 are diagrams illustrating examples of a dividing position displayed on the display unit. Next, a printing operation of the printing apparatus 1 will be described with reference to FIG. 3 to FIG. 5.

At step S1, the printing apparatus 1 receives print data from a computer as the external device 10.

At step S2, it is determined whether or not maintenance is necessary. In order to maintain printing quality, the printing apparatus 1 needs to suspend a printing operation at predetermined intervals to perform maintenance of the print head 15. The controller 7 determines whether or not maintenance is necessary before the completion of printing based on the print data received at step S1. If maintenance is necessary (step S2: Yes), step S3 is entered. If maintenance is not necessary (step S2: No), step S8 is entered, and printing of the print data is performed and the printing operation is then stopped.

At step S3, a dividing position is displayed. Based on remaining time to maintenance and the print data, the controller 7 calculates a dividing position for suspending the printing operation. The controller 7 then causes the display unit 8 to display an image of the portion and one or more candidate dividing positions at which the printing operation is suspended. The dividing position is indicated as a continuous line running from one end to the other end of the recording medium W in the primary scanning direction.

An example of details of a display on the display unit 8 will be described.

Based on print data, the controller 7 displays on the display unit 8 a dividing position at which a boundary due to a suspension and a resumption of a printing operation is less likely to be visually recognized. For example, as illustrated in FIG. 4, when an image in which square unit images P1 having boundaries are arranged in a matrix and cover the recording medium W without a gap (hereafter, referred to as a tiling image) is printed, the control unit 7 sets a dividing position along boundaries of the unit images P1 in the transport direction (X-axis direction). The controller 7 then indicates a candidate dividing position for suspending printing with a straight line (a continuous line) running from one end to the other end of the recording medium W. In FIG. 4, one candidate dividing position is indicated by an arrow "1".

Another example of details of a display on the display unit 8 will be described.

For example, as illustrated in FIG. 5, when a tiling image in which a plurality of unit images P1 aligned in the X-axis direction (the secondary scanning direction) are arranged in a staggered manner in the Y-axis direction (the primary scanning direction) is printed, the controller 7 sets a dividing position based on the boundary of the unit images P1, the pattern and color of the unit images P1, or the like. The controller 7 indicates candidate dividing positions for suspending printing with continuous lines running from one end to the other end of the recording medium W. In FIG. 5, three candidate dividing positions are indicated by arrows "1" to "3". The dividing position indicated by the arrow "1" is a straight line that does not overlap with each of the main patterns of the unit images P1, and each of the dividing positions indicated by the arrows "2" and "3" is a comb-teeth line along the boundaries of the unit images.

At step S4, a dividing position is designated. A user can operate the operating unit 9 and select a desired dividing position from the dividing positions displayed on the display unit 8.

At step S5, printing is performed up to the dividing position. Step S5 is a step of suspending the printing operation at a dividing position that has been designated by the print data. The controller 7 cooperatively controls the print head 15, the carriage motion mechanism 16, and the medium transport mechanism 12 to perform printing up to the dividing position designated in advance at step S4 and then suspends the printing operation. Note that, in multipath printing such as an interlace system or an overlap system, a printing operation is suspended after a terminal process up to a dividing position.

At step S6, maintenance is carried out. The controller 7 controls the maintenance section 13 to perform maintenance such as absorption, wiping, and flushing of the print head 15.

At step S7, printing is performed from the dividing position. Step S7 is a step of resuming a printing operation. The controller 7 cooperatively controls the print head 15, the carriage motion mechanism 16, and the medium transport mechanism 12 to resume printing from the dividing position designated in advance at step S4 and completes the printing operation. Note that, when any of the dividing positions indicated by the arrows "1" to "3" of FIG. 5 is selected, the controller 7 controls the medium transport mechanism 12 to transport the recording medium W back once in the −X-axis direction (back feed) before resuming printing.

Note that, although the present embodiment has been described by using tiling with squares, tiling with equilateral triangles or regular hexagons may be employed.

Further, although the present embodiment has exemplified the ink jet printing apparatus 1 for textile printing, the invention is not limited thereto. The invention is generally applicable to ink jet printing apparatuses that transport a recording medium W in a roll-to-roll system.

As described above, the printing apparatus 1 according to this embodiment allows for the following advantages.

The printing apparatus 1 has the controller 7 that, when there is a need for suspending a printing operation to perform maintenance, cooperatively controls the print head 15, the carriage motion mechanism 16, and the medium transport mechanism 12 to suspend the printing operation at a dividing position designated in advance and resume the printing operation. Further, the printing apparatus 1 has the display unit 8 that displays one or more candidate dividing positions and the operating unit 9 that instructs a user to select a dividing position. Based on print data, the controller 7 indicates, as one or more dividing positions, locations at each of which a boundary due to a suspension and a resumption of a printing operation is less likely to be visually recognized, and a dividing position is selected and determined by the user. Thereby, a dividing position where a boundary due to a suspension and a resumption of a printing operation is less likely to be visually recognized is designated, which can prevent production of a print of lower commercial value. Therefore, the printing apparatus 1 with improved productivity can be provided.

When printing a tiling image in which the recording medium W is covered with the unit images P1 without a gap, the controller 7 indicates one or more candidate dividing positions by one or more continuous lines (a straight line, a comb-teeth line, or the like) running from one end to the other end of the recording medium W based on the boundary, the pattern and color, or the like of the unit images P1. It is therefore possible to print an image in which a color unevenness, a color difference, or the like caused when a printing operation was suspended and resumed is less likely to be visually recognized.

The printing method of the printing apparatus 1 includes, when there is a need for suspending a printing operation for maintenance, a step of suspending a printing operation at a dividing position that has been designated in print data and a step of resuming the printing operation. One or more locations at each of which a boundary caused when a printing operation will be suspended and resumed are displayed on the display unit 8 based on the print data, and a dividing position is selected and determined by a user. Thereby, a printing operation is suspended and resumed at a dividing position at which the position due to a suspension and a resumption of a printing operation is less likely to be visually recognized, which can prevent production of a print of lower commercial value. Therefore, the printing method having improved productivity can be provided.

Second Embodiment

Figure 6:
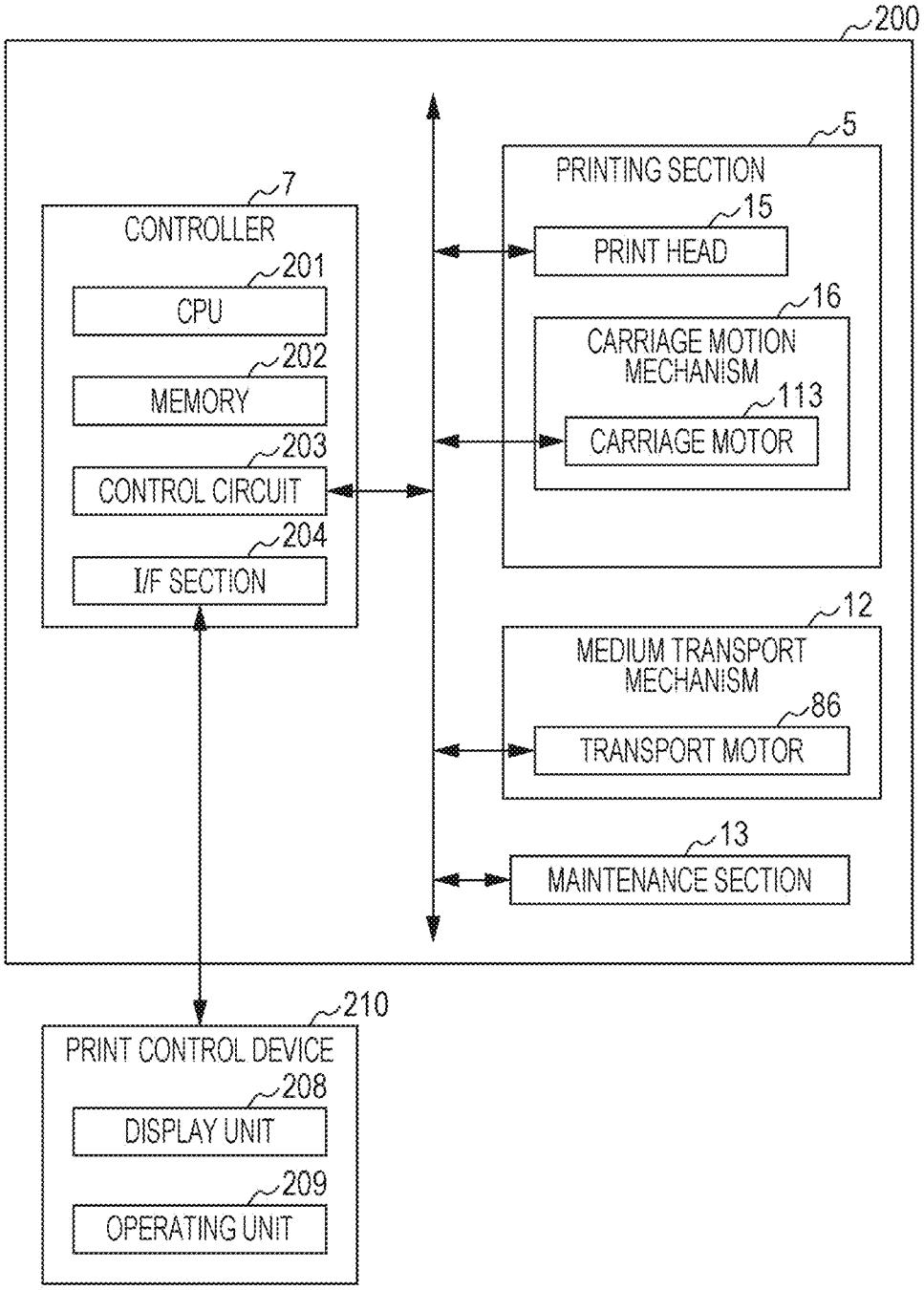
FIG. 6 is an electrical block diagram illustrating an electrical configuration of a printing apparatus according to a second embodiment.
Figure 7:
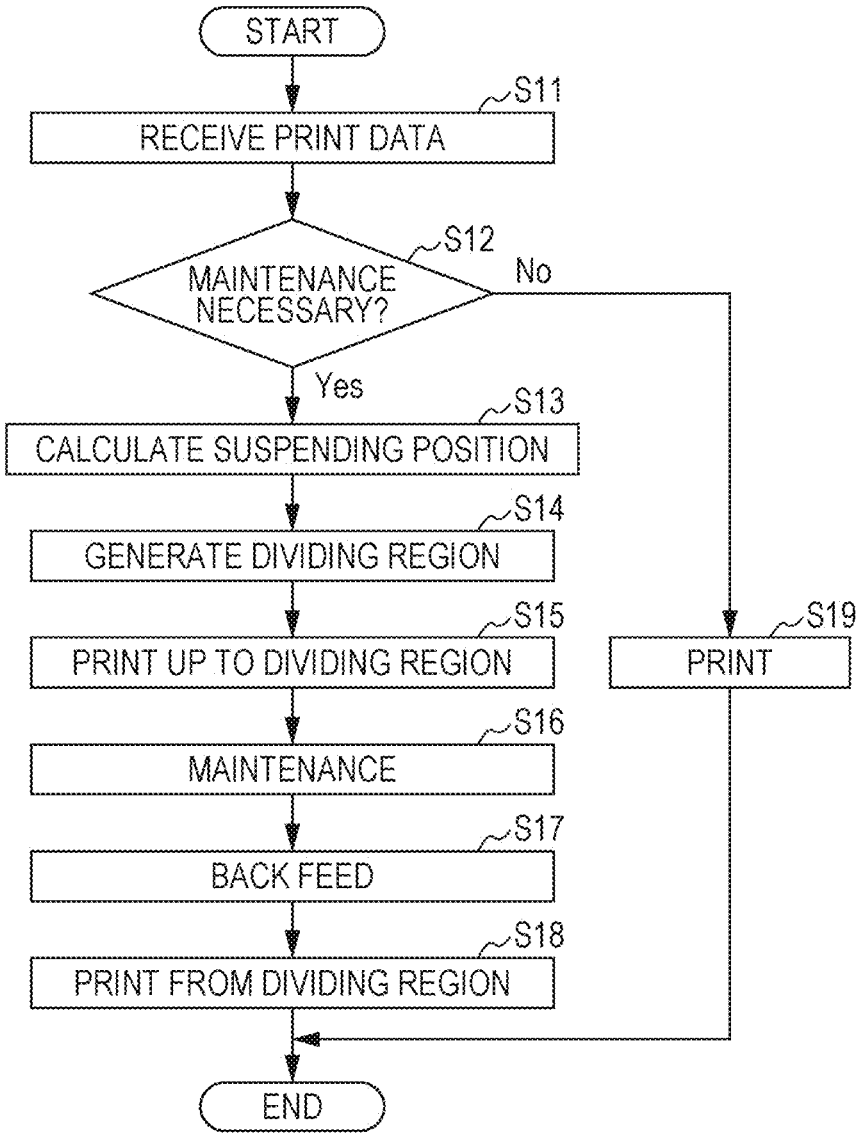
FIG. 7 is a flowchart illustrating a printing operation.
Figure 8:
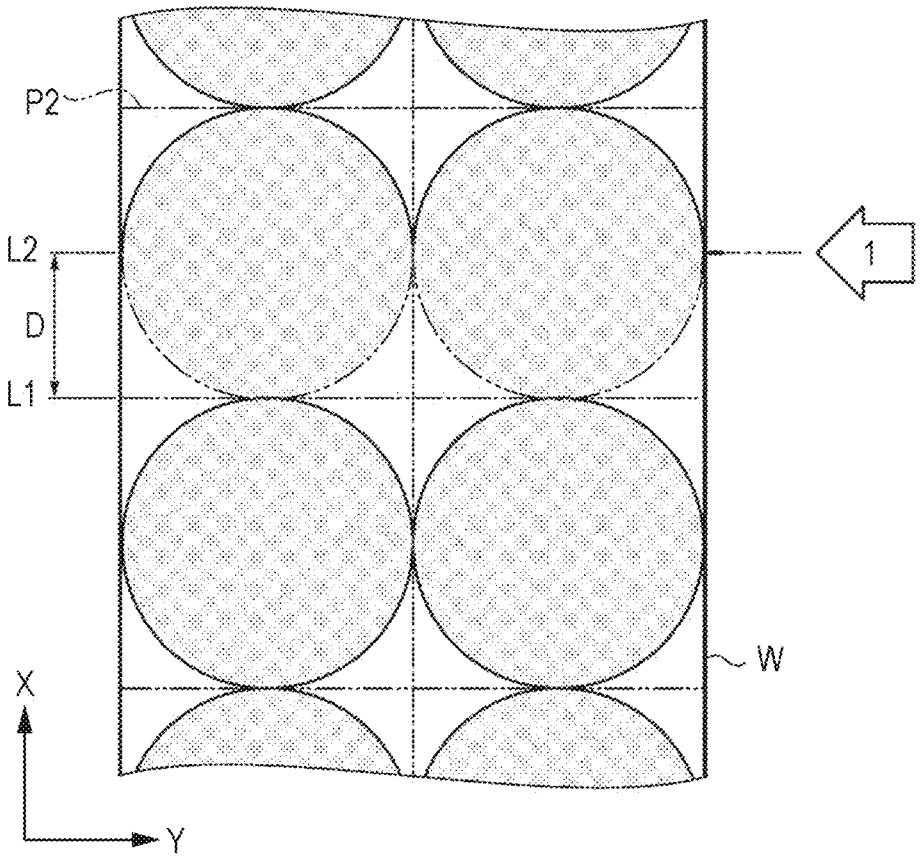
FIG. 8 is a diagram illustrating an example of a dividing region displayed on the display unit.
Figure 9:
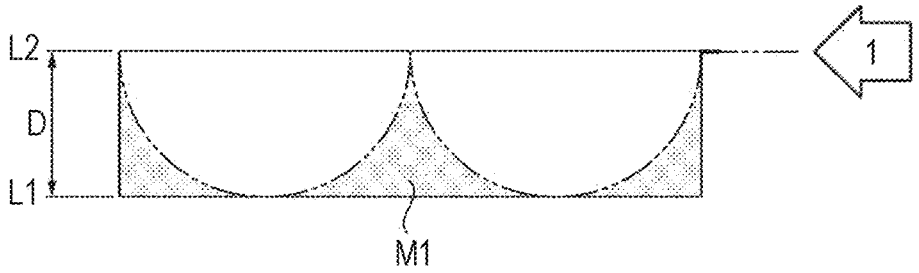
FIG. 9 is a diagram schematically illustrating mask data when printing a dividing region D.
Figure 10:
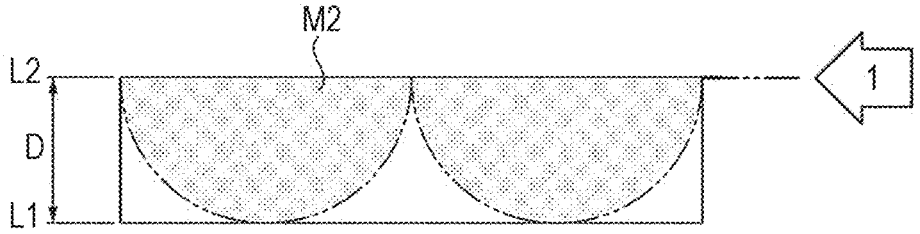
FIG. 10 is a diagram schematically illustrating mask data when printing a dividing region D.

FIG. 6 is an electrical block diagram illustrating an electrical configuration of a printing apparatus according to the second embodiment. FIG. 7 is a flowchart illustrating a printing operation. FIG. 8 is a diagram illustrating an example of a dividing region displayed on a display unit. FIG. 9 and FIG. 10 are diagrams schematically illustrating mask data when a dividing region D is printed. A printing apparatus 200 and a printing operation of the present embodiment will be described with reference to FIG. 6 to FIG. 10. Note that, in this embodiment, the display unit and the operating unit which are provided to the printing apparatus 1 in the first embodiment are provided to a print control device as an external device. Further, the same components as those in the first embodiment are labeled with the same reference numerals as those in the first embodiment, and the duplicated description thereof will be omitted.

As illustrated in FIG. 6, the I/F section 204 transmits and receives data with a print control device 210 that handles an input signal, image, or the like. The print control device 210 is a desktop or laptop personal computer (PC) having a display unit 208 and an operating unit 209. The display unit 208 is formed of a liquid crystal display, for example, and the operating unit 209 is formed of various hard keys, a touch screen, or the like provided on the surface of the display unit 208 (liquid crystal display). The display unit 208 displays various command choices by Graphical User Interface (GUI) buttons or the like and various commands can be input by a user selecting a command through the operating unit 209.

Next, a printing operation of the printing apparatus 200 will be described with reference to FIG. 7 and FIG. 8.

At step S11, the printing apparatus 200 receives print data from the print control device 210.

At step S12, it is determined whether or not maintenance is necessary. In order to maintain printing quality, the printing apparatus 200 needs to suspend a printing operation every predetermined time to perform maintenance of the print head 15. The controller 7 determines whether or not maintenance is necessary before the completion of printing based on the print data received at step S11. If maintenance is necessary (step S12: Yes), step S13 is entered. If maintenance is not necessary (step S12: No), step S19 is entered, and printing of the print data is performed and the printing operation is then stopped.

At step S13, a suspending position is calculated. Based on remaining time to maintenance and the print data, the controller 7 calculates a dividing position for suspending the printing operation and transmits suspending position data to the print control device 210 via the I/F section 204. The print control device 210 causes the display unit 208 to display an image of the suspending position. The user can input a suspending position through the operating unit 209. For example, the user can use a mouse, a stylus, or the like as the operating unit 209 to input a dividing position by a continuous line running from one end to the other end of the recording medium W on the display unit 208 where the image is displayed.

An example of details of a display on the display unit 208 will be described.

For example, as illustrated in FIG. 8, in a case of an image in which square unit images P2 having no boundary are arranged in a matrix and cover the recording medium W without a gap, the position where a printing operation was suspended and resumed may be less likely to be visually recognized when edges of the patterns (circles) of the unit images P2 are used as a dividing position rather than when boundaries of the squares of the unit images P2 are used as a dividing position. In such a case, the user can refer to the image displayed on the display unit 208 and input a dividing position indicated by an arrow "1", for example.

At step S14, a dividing region is generated. The controller 7 receives dividing position data input by the user from the print control device 210. The controller 7 then defines, as a dividing region D, a region occluded by a first straight line L1, which contacts with the upstream end of the dividing position indicated by a continuous line of the arrow "1" and runs in the primary scanning direction, and a second straight line L2, which contacts with the downstream end of the dividing position and runs in the primary scanning direction.

At step S15, printing is performed up to the dividing region D. The controller 7 cooperatively controls the print head 15, the carriage motion mechanism 16, and the medium transport mechanism 12 to perform printing up to the dividing region D generated at step S4 and then suspends the printing operation. FIG. 9 is a diagram schematically illustrating mask data used when a dividing region D is printed in this step. The controller 7 generates mask data M1 for not ejecting ink from the print head 15 for a region occluded by the dividing position indicated by the arrow "1" and the first straight line L1 as illustrated in FIG. 9. In a printing operation of the dividing region D obtained before maintenance is carried out, the controller 7 then performs printing with overlapping the mask data M1 on the print data of the dividing region D. Thereby, printing is performed up to the dividing position indicated by the arrow "1". Note that, in multipath printing such as an interlace system or an overlap system, a printing operation is suspended after a terminal process up to a dividing position. When there are a plurality of dividing positions, any dividing position may be selected from dividing positions displayed in a selectable manner through the operating unit 209.

At step S16, maintenance is carried out. The controller 7 controls the maintenance section 13 to perform maintenance such as absorption, wiping, and flushing of the print head 15.

At step S17, a back feed is performed. The controller 7 controls the medium transport mechanism 12 to adjust a position for resuming printing to the second straight line L2 of the dividing region D. Note that a back feed may be applied when maintenance is being performed, which allows for an immediate resumption of printing when resuming printing, and an unnecessary standby period where no printing is performed can be reduced to improve the throughput.

At step S18, printing is performed from the dividing region D. The controller 7 cooperatively controls the print head 15, the carriage motion mechanism 16, and the medium transport mechanism 12 to resume printing from the second straight line L2 of the dividing region D and completes the printing operation. FIG. 10 is a diagram schematically illustrating mask data used when a dividing region D is printed in this step. The controller 7 generates mask data M2 for not ejecting ink for a region occluded by the dividing position indicated by the arrow "1" and the second straight line L2. The mask data M2 is the inversion of the mask data M1. In a printing operation of the dividing region D resulted after maintenance has been carried out, the controller 7 then performs printing with overlapping the mask data M2 on the print data of the dividing region D. Thereby, printing is resumed from the dividing position indicated by the arrow "1". In this embodiment, printing of the dividing region D is performed before and after maintenance. Thus, with print data of the dividing region D being held in the memory 202, there is no need for reloading print data. Thereby, when the printing is resumed, the time before the printing is actually started can be reduced, which can improve the productivity of the printing apparatus 200.

As described above, the controller 7 calculates a position at which maintenance is necessary. A user can input through the operating unit 209 a dividing position for suspending printing while confirming an image displayed on the display unit 208 of the print control device 210. Since the controller 7 performs printing and maintenance based on the dividing position, the position at which a printing operation was suspended at the maintenance is less likely to be visually recognized, and a print that reflects a user's intention is generated.

As described above, the printing apparatus 200 according to this embodiment allows for the following advantages.

Since the controller 7 of the printing apparatus 200 performs printing and maintenance based on a dividing position input by a user, the position at which a printing operation was suspended is less likely to be visually recognized, and a print that reflects a user's intention is generated. This can prevent production of a print of lower commercial value. Therefore, the printing apparatus 200 with improved productivity can be provided.

The controller 7 defines the dividing region D occluded by the first straight line L1, which contacts with the upstream end of the dividing position in the transport direction and runs in the primary scanning direction, and the second straight line L2, which contacts with the downstream end of the dividing position in the transport direction and runs in the primary scanning direction. In a printing operation of the dividing region D obtained before maintenance is carried out, the controller 7 performs printing with overlapping the mask data M1, which is for not ejecting ink, on the print data of the dividing region D. Then, in a printing operation of the dividing region D resulted after the maintenance has been carried out, the controller 7 performs printing with overlapping the mask data M2, which is for not ejecting ink, on the print data of the dividing region D. In this embodiment, printing of the dividing region D is performed before and after maintenance. Thus, with print data of the dividing region D being held in the memory 202, there is no need for reloading print data after the maintenance. When the printing is resumed, the time before printing is actually started can be reduced, which can further improve productivity of the printing apparatus 200.

What is claimed is:

1. A printing apparatus comprising:

a medium transport mechanism that transports a recording medium in a transport direction;

a print head that ejects a liquid onto the recording medium;

a printing section that performs printing by ejecting a liquid from the print head onto the recording medium based on print data;

a controller that controls a suspension and a resumption of a printing operation at a dividing position; and a display unit that indicates one or more candidate dividing positions for suspending a printing operation to instruct a selection, wherein the dividing positions are based on the print data.

2. The printing apparatus according to claim 1, further comprising a maintenance section that performs maintenance of the print head, wherein the controller causes the maintenance section to perform maintenance of the print head between the suspension and the resumption of the printing operation.

3. The printing apparatus according to claim 1, wherein the dividing position is indicated by a continuous line running from one end to the other end of the recording medium in a scanning direction intersecting the transport direction.

4. The printing apparatus according to claim 3, wherein the continuous line is a straight line.

5. The printing apparatus according to claim 3, wherein the continuous line is a comb-teeth line.

6. The printing apparatus according to claim 3, wherein a region occluded by a first straight line that is in contact with an upstream end of the continuous line and runs in the scanning direction and a second straight line that is in contact with a downstream end of the continuous line and runs in the scanning direction is defined as a dividing region, and wherein the controller masks a region occluded by the first straight line and the continuous line and performs printing up to the dividing region when suspending a printing operation and masks a region occluded by the second straight line and the continuous line and performs printing from the dividing region when resuming a printing operation.

7. A printing method of a printing apparatus, wherein the printing apparatus comprises a medium transport mechanism that transports a recording medium in a transport direction, a print head that ejects a liquid onto the recording medium, a printing section that performs printing by ejecting a liquid from the print head onto the recording medium based on print data, the method comprising:

suspending a printing operation at a dividing position;

resuming the printing operation; and indicating on a display unit one or more candidate dividing positions for suspending a printing operation to instruct a selection, wherein the dividing positions are based on the print data.

8. A printing apparatus comprising:

a medium transport mechanism that transports a recording medium in a transport direction;

a print head that ejects a liquid onto the recording medium;

a printing section that performs printing by ejecting a liquid from the print head onto the recording medium based on print data;

a controller that controls a suspension and a resumption of a printing operation at a dividing position, and causes to display one or more candidate dividing positions for suspending a printing operation to instruct a selection on a display unit of a print control device that is connected with a communication interface, wherein the dividing positions are based on the print data.

* * * * *